United States Patent [19]

Haberer

[11] Patent Number: 5,018,588

[45] Date of Patent: May 28, 1991

[54] ANCHOR DRILLING IMPLEMENT

[75] Inventor: Johann Haberer, Schrobenhausen, Fed. Rep. of Germany

[73] Assignee: Bauer Spezialtiefbau GmbH, Fed. Rep. of Germany

[21] Appl. No.: 587,575

[22] Filed: Sep. 25, 1990

Related U.S. Application Data

[63] Continuation of Ser. No. 361,384, Jun. 5, 1989, abandoned.

[30] Foreign Application Priority Data

Jun. 8, 1988 [DE] Fed. Rep. of Germany ..... 3819537

[51] Int. Cl.[5] ..... E21B 7/02

[52] U.S. Cl. ..... 173/22; 173/28; 173/164; 175/52; 175/85

[58] Field of Search ..... 173/22, 28, 39, 42, 173/43, 44, 164; 175/52, 85

[56] References Cited

U.S. PATENT DOCUMENTS 4,258,796 3/1981 Horning et al. ..... 173/28 X
4,703,811 11/1987 Lam ..... 173/28
4,785,892 11/1988 Luen ..... 173/39 X

*Primary Examiner*—Douglas D. Watts
*Assistant Examiner*—William Fridie, Jr.
*Attorney, Agent, or Firm*—Mason, Fenwick & Lawrence

[57] ABSTRACT

An anchor drilling implement for producing soil anchors is described, which is provided with a drill carriage and a pivotable and vertically adjustable drilling mount. The drill carriage comprises a caterpillar gear and an implement upper part rotatable by means of a turntable and carrying a support for the mount. The implement upper part also carries a driving cab in the immediate vicinity of the support, so that said cab performs all the support movements and an unrestricted view of the drill hole or shaft is ensured in any position of the mount. The drilling mount is preferably also provided with a tool magazine, which can be controlled from the driving cab.

2 Claims, 1 Drawing Sheet

ANCHOR DRILLING IMPLEMENT

This application is a continuation of U.S. Pat. application Ser. No. 361,384, filed Jun. 5, 1989 now abandoned.

BACKGROUND OF THE INVENTION

The invention relates to an anchor drilling implement with a drill carriage and a mount fitted thereto for the introduction of load achors into the soil.

As is known, in construction engineering load anchors are used for securing bulkheads or face walls in a given angular range. The anchor is subsequently inserted and then achored in the soil by pressing in a filling material. In order to obtain favorable square metre prices during sheeting, long load anchors are being increasingly used. Whereas previously mainly single rod anchors wih diameters of 26 and 32 mm have been sheeted, requiring drilling tools with diameters of 70 to 76 mm, rigs with diameters of 133 mm and more are nowadays conventionally used for the frequently required stranded anchors.

For both economic and drilling reasons, it is necessary to work simultaneously with two rigs, so that the inner tool with the valuable core bit can be removed from the piped bores occuring when using known drilling methods.

considerable physical effort can be involved in operating an anchor drilling implement and particularly the replacement of the drilling tool in the rough surroundings of a building site.

SUMMARY OF THE INVENTION

The problem of the present invention is to provide an anchor drilling implement of the aforementioned type, where working is simplified and the changeover times reduced, whilst simultaneously permitting the use of heavy anchor drilling implements.

This problem is solved by provision of a drill carriage having a rotatably mounted upper part and a support positioned on the upper part, wherein the support carries a drilling mount and project over the gear so that the drilling mount can pivot unhindered, and the upper part carries a driving cab positioned laterally alongside the support. Further developments of the invention comprise provision of a tool magazine on the drilling mount, wherein the tool magazine can be hydraulically operated under the control of the driving cab. The invention has the advantage that considerable forces can be transferred From the drilling mount, via the support to the rotary upper part of the tool and operation and monitoring of the anchor drilling implement during drilling, including the drilling, grouting and pulling-out can be carried out by the foreman driller alone. The operating can be extremely near to the drilling site, so that he has an optimum view of the latter and also the drilling string. Through the positioning of the mount, drill chips drop freely and do not come into contact with machine parts. As a result of the automated tool installation and disassembly and the placing in and removal from store, no manual work is necessary and it is possible to use tools with a relatively large diameter, e.g. up to 176 mm with lengths of e.g. up to 6 m. This leads to a considerable drilling advance and short stoppages, whilst avoiding any heavy physical work. The invention is described in greater detail hereinafter relative to an embodiment and the attached drawings.

DESCRIPTION OF THE PREFERRED EMBODIMENT

Figure 1:
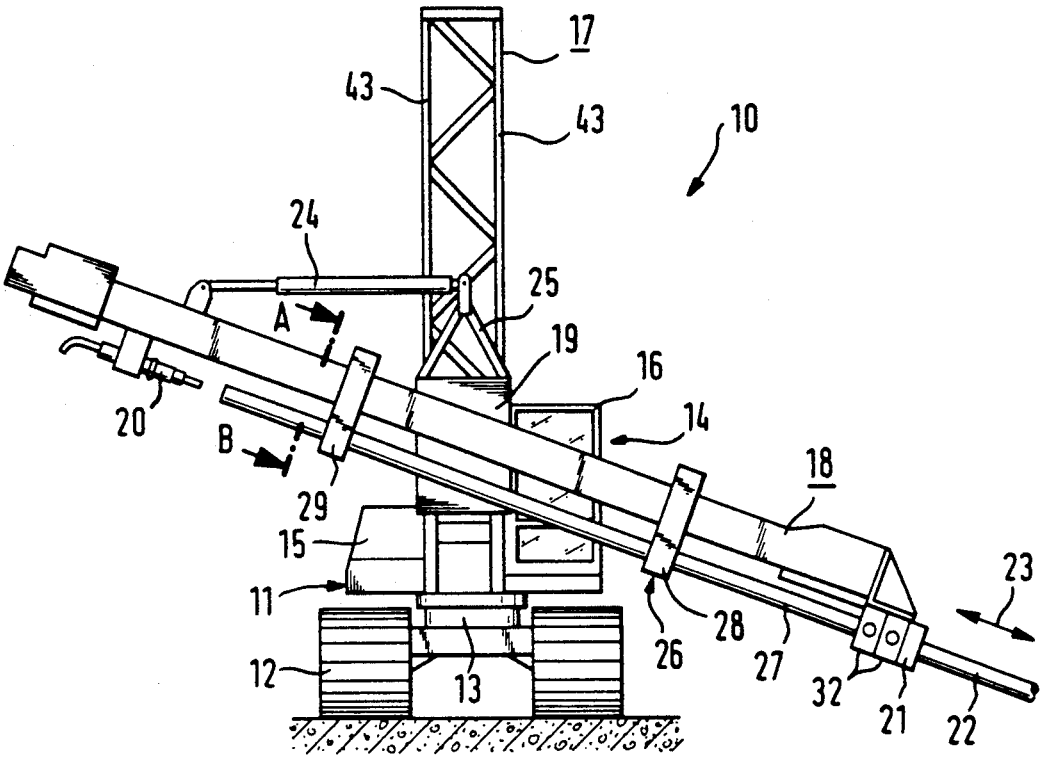
FIG. 1 Diagrammatically shows a front view of an anchor drilling implement.

As shown in FIG. 1, an anchor drilling implement 10 has a drill carriage 11 with a caterpillar gear 12, on which is mounted in rotary manner the upper part 14 of the implement 10 by means of a slewing ring or turntable 13. It comprises a drive unit 15, an operating position for a drilling foreman surrounded by a closed driving cab 16 and a support 17 for receiving a drill mount 18 arranged substantially perpendicularly with respect to the turntable 13. Mount 18 is pivotably mounted in a sliding carriage 19, which is vertically displaceably guided on support 17.

Mount 18 carries a drilling drive 20 and a front mounting support 21 and clamping jaws 32 for a not shown drill or drilling tool enabling the drill or drilling tool to be held in the drilling position. In order to make the drawing easier to understand, a rear mounting support for the drill or drilling toll in the drilling position is not shown. In FIG. 1 a drilling tool part 22 projects in the drilling direction over and beyond the mounting support 21 or mount 18, where it is moved outwards according to arrow 23 on sinking the shaft and inwards on pulling out. The drilling tool is rotatably held on the mount 18 in the drilling position. In the direction of travel, support 17 is located on the front boundary of the drill carriage 11, so that the drilling mount 18 can be pivoted in free space in the drawing plane upstream of support 17 and the caterpillar gear 12. Thus, the drilling mount 18 can be pivoted in a random angle of inclination. The attachment level for the drilling point is fixed by a longitudinal displacement of sliding carriage 19. The support comprises two transversely stiffened steel rails 43. The drilling mount 18 is pivoted hydraulically by means of a hydraulic cylinder 24 which is arranged between the rear end of the mount 18 and an arm 25 on the top of sliding carriage 19, which is also hydraulically vertically adjustable.

The drilling mount 18 also carries a hydraulically operated tool magazine 26 for receiving serveral tool pipes 27, which in the represented example are located in a row at right angles to the drawing plane, so that only the first tool pipe is visible, the others being concealed. The tool pipes 27 in tool magazine 26 also conceal the drilling tool located in the extension of the tool part 22 in the drilling position.

The tool magazine 26 comprises two approximately U-shaped mounting supports 28, 29 which, at right angles to the drawing plane, are fixed to mount 18 in such a way that the tool magazine 26 also performs any pivoting and vertical movement of the mount 18. Thus, the repeated insertion and removal from store is ensured in any position of the drilling mount 18.

Figure 2:
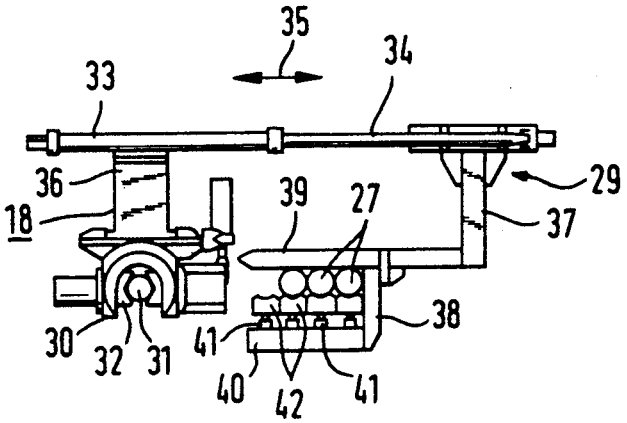
FIG. 2 Diagrammatically shows a cross-section along line A-B through the mount of the anchor drilling implement according to FIG. 1.

FIG. 2 shows a cross-section A-B through the mount 18 and the tool magazine 26. Thus, the mount 18 comprises a steel carrier 36, on whose underside is arranged a rear mounting support 30 for a tool pipe 31 in the drilling position. The tool pipe 31 rotatably mounted in the rear mounting support 33 and is held by two jaws 32. The subsequently described details of the tool magazine 26 relate to the mounting support 29, which is identical to mounting support 28 (FIG. 1). On the top of the drilling mount 18 is provided a further hydraulic cylinder 33 movable at right angles to the longitudinal axis thereof and by means of which a push rod 34 is longitudinally displaceable in accordance with arrow 35. At the free end of push rod 34 is provided a carrier arm 37, to whose free end is fixed a fork 38 for receiving the tool pipes 27. Fork 38 serves as a longitudinal magazine for tool pipes 27, which are fixed in juxtaposed detachable manner between an upper and a lower fork arm 39, 40 parallel to push rod 34. Fixing takes place with the aid of hydraulic cylinders 41, which are in each case associated with one of the tool pipes. The hydraulic cylinders 41 are supported on the lower fork arm 40, whilst the tool pipes 27 are pressed with the aid of holding jaws 42 onto the free ends of hydraulic cylinders 41 on the upper fork arm 39. As a result of a corresponding pressure the tool pipes 27 can be reliably held in any position of the drilling mount 18.

In the case of a tool change, the fork 38 is moved into a position below mount 18 through a longitudinal movement of push rod 34 in such a way that a tool pipe 27 in fork 38 come to rest in a position, in which it can be screwed to an already drilled tool portion 22 (FIG. 1) or can be unscrewed from such a portion 22. By opening the particular hydraulic cylinder 41 a removal from or an insertion in fork 38 is readily possible. Screwing can also take place automatically with the aid of the hydraulically operable clamping jaws 32 and controlled from the driving cab 16.

In order to make the drawing easy to understand, all the line connections from the drive unit 15 to the individual hydraulic cylinders are not shown.

Figure 3:
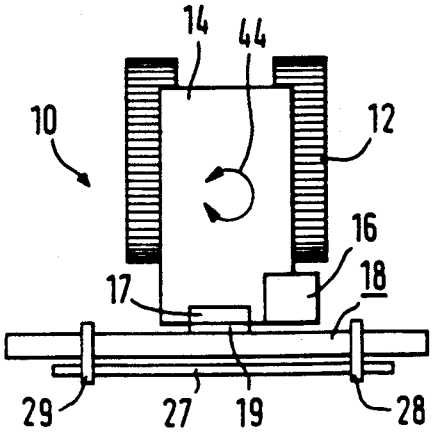
FIG. 3 Diagrammatically shows a plan view of the anchor drilling implement according to FIG. 1.

From the plan view of the anchor drilling implement 10 according to FIG. 3, it is apparent that the driving cab 16 is in the immediate vicinity of the area of mount 18 facing the shaft or drill hole and on the front end of the drill carriage 11 in the direction of travel. Thus, the operator has all the essential units for the drilling process and also the drill hole clearly in his field of view. As all the control means are also ergonomically positioned in the driving cab 16, the anchor drilling implement 10 can be reliably controlled by one person.

Support 17 and drilling mount 18 are positioned upstream of the end of the caterpillar gear 12 in the direction of travel with a sufficiently large free space, so that an unimpeded pivoting of mount 18 is possible. As a result of this significant projection, it is also ensured that during rotary movement of the upper part of the implement on the caterpillar gear according to arrow 44 in any rotary position there is sufficient free space for an unimpeded pivoting of mount 18.

As support 17 is directly fixed to the upper part 14 of the implemented 10, it can absorb very high forces. Therefore mount 18 can be up to 10 m long and loaded with several correspondingly long tool pipes. The support 17 can also absorb very considerable driving forces. Particularly if support 17 is fixed by screwing or welding to the implemented upper part 14, instead of being articulated thereto, it is possible to absorb large forces, without having to accept significant restrictions regarding the degree of freedom during the orientation of mount 18. The driving cab 16 is also at an optimum distance from the drill hole in any rotary position of the implement upper part.

It can be appropriate to provide the support 17 with a slight rearward slope towards the centre of the anchor drilling implement. This measure ensures that the mount 18 with increasing vertical adjustment for weight displacement purposes is moved towards the centre of implement 10. Thus, a reliable stability of the anchor drilling implement 10 is ensured.

What is claimed is:

1. An anchor drilling implement comprising:

caterpillar gear means for moving said implement;

a drill carriage comprising an upper part and a support positioned on said upper part, said drill carriage and said upper part each having a front end in the direction of forward travel, a back end in the direction of backward travel, a first side in the direction of drilling, and a second side opposite the direction of drilling, said support being positioned at said front end of said upper part and projecting over said caterpillar gear means, and said upper part being mounted on said caterpillar gear means for rotation 180° about a vertical axis;

a sliding carriage vertically displaceably guided on said support;

a vertically adjustable arm positioned on said sliding carriage;

a drilling mount pivotable in a vertical plane and vertically adjustable on said support, said drilling mount having a drilling end;

mounting means for pivotably mounting said drilling mount to said arm and thereby to said support, whereby said drilling mount can pivot unhindered in a vertical plane;

hydraulically-operated tool magazine means carried on said drilling mount for receiving a plurality of tool pipes and inserting a selected one of the tool pipes in and removing the selected tool pipe from said drilling mount; and a driving cab positioned on said upper part laterally alongside said support, at said front end and said first side of said upper part, said tool magazine means being arranged on said drilling mount within sight of an operator located in said driving cab, and said tool magazine being hydraulically operated under the control of said driving cab in all rotation positions of said upper part.

2. The anchor drilling implement of claim 1, further comprising cylinder means and arm means for connecting said drilling mount to said drill carriage.

* * * * *